United States Patent [19]

Joret

[11] 4,253,819

[45] Mar. 3, 1981

[54] SYSTEM FOR THE COMBUSTION OF LIQUID FUEL, NOTABLY OF THE MINERAL-OIL TYPE

[75] Inventor: Robert Joret, Angouleme, France

[73] Assignee: S.E.C.O.M.A.T., Societe Europeenne de Construction Mechanique Automobile et Thermique, Angouleme, France

[21] Appl. No.: 52,919

[22] Filed: Jun. 26, 1979

[30] Foreign Application Priority Data

Jul. 13, 1978 [FR] France ..... 78 21066

[51] Int. Cl.[3] ..... F23D 11/44

[52] U.S. Cl. ..... 431/208; 137/576

[58] Field of Search ..... 431/208; 137/576

[56] References Cited

U.S. PATENT DOCUMENTS

| | | | |
|---|---|---|---|
| 1,202,050 | 10/1916 | Gamble | 137/576 |
| 2,608,246 | 8/1952 | Morey | 431/208 |
| 2,753,928 | 7/1956 | Vanderlip | 431/208 |
| 3,186,469 | 6/1965 | Younger | 431/208 |
| 3,975,139 | 8/1976 | Arroyo-Garcia | 431/208 |
| 4,090,530 | 5/1978 | Lange | 137/576 |

*Primary Examiner*—George E. Lowrance

*Attorney, Agent, or Firm*—Wenderoth, Lind & Ponack

[57] ABSTRACT

This system for burning low-grade fuels, notably used mineral oils, comprises a first so-called decantation tank receiving the fuel and connected, through an overflow device, to a second so-called storage tank, and a burner connected to this storage tank. The first decantation tank comprises means for heating the fuel under the control of a thermostat. A level detector is incorporated in the storage tank and connected to a pump inserted in the circuit supplying fuel to the first tank. The burner comprises a pump set to supply fuel to the burner jet through a reservoir provided with reheating means, so that the fuel delivered to the burner has a minimum temperature of 100° C.

7 Claims, 3 Drawing Figures

SYSTEM FOR THE COMBUSTION OF LIQUID FUEL, NOTABLY OF THE MINERAL-OIL TYPE

SUMMARY OF THE INVENTION

This invention relates to a system for burning liquid fuel, notably of the mineral-oil product type, wherein burners are mounted in combustion apparatus such as, for example, boilers, furnaces and the like.

This invention is directed more particularly to a system capable of utilizing low-grade liquid fuels which, up to now, were considered as non-usable under economical conditions, on account of their contents of non-combustible waste.

This invention is characterized essentially in that it comprises a first so-called decantation tank to which the fuel is supplied, this first tank being connected to a second so-called storage tank connected in turn to the burner in order to feed fuel thereto.

According to another feature characterizing this invention, the first so-called decantation tank comprises heating means, the operation of which is controlled by a thermostat.

According to a further feature characterizing this invention, the second so-called storage tank comprises a level gage, connected to a pump inserted in the circuit supplying fuel to the first so-called decantation tank.

According to a specific feature characterizing this invention, the overflow means connecting the first decantation tank to the second storage tank consists of a partition so disposed between the two tanks that its top edge determines the level whereat the fuel flows from the first to the second tank.

DETAILED DESCRIPTION OF THE INVENTION

Figure 1:
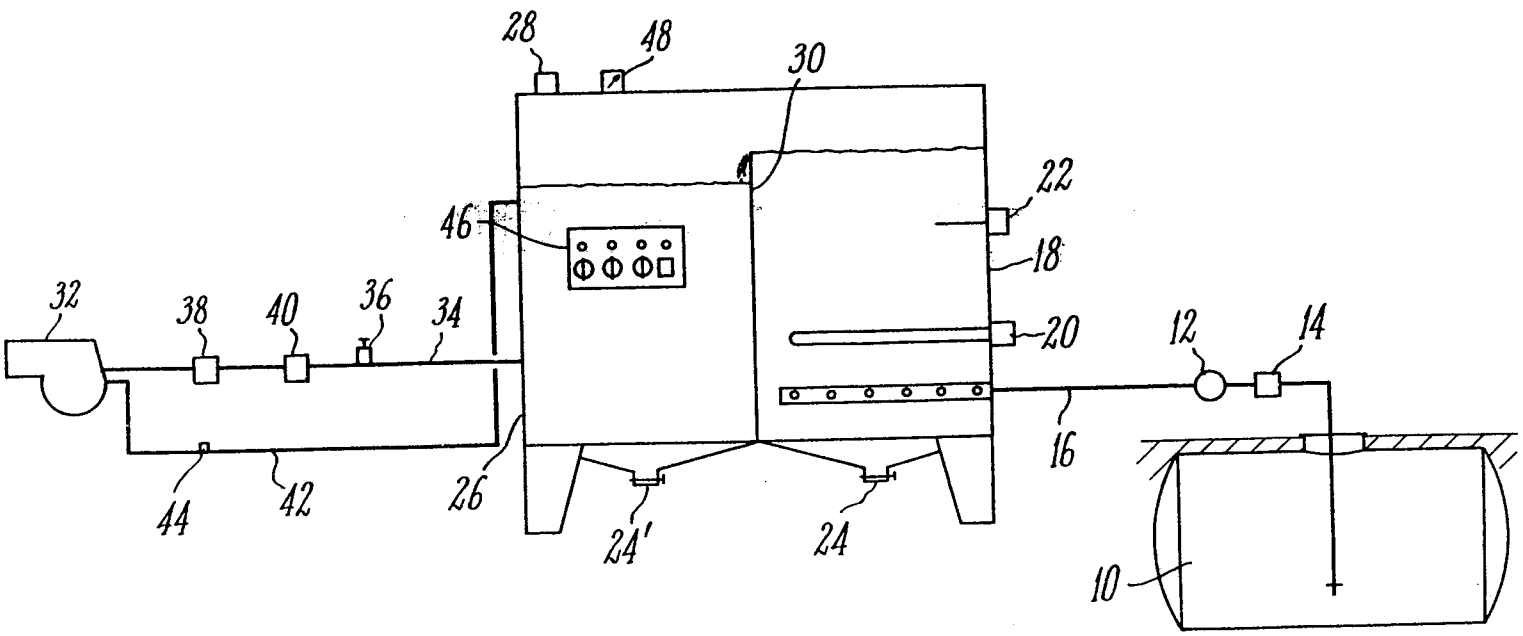
FIG. 1 is a diagrammatic side elevational view of the system according to this invention.

This invention is directed to a system or plant which is both constructionally simple and reliable in operation, and intended notably for burning low-grade mineral-oil products such as, for instance, used motor oils, irrespective of the room temperature.

According to this invention, the liquid fuel to be used is stored (see FIG. 1) in a tank 10 which may, according to the known practice, be either buried or laid at floor or ground level. A pump 12 is provided for transferring the fuel from the tank 10, via a conduit 16, to a first socalled decantation tank 18. A filter 14 is inserted in this conduit 16.

The decantation tank 18 is provided with heating means, capable of maintaining the temperature necessary for decanting the oil. In this specific embodiment, these heating means comprise an electric heating resistance 20, controlled by means of a thermostat 22. With this arrangement, the decantation takes place in the tank 18 so that the heavy (waste) particles are precipitated to the tank bottom. The waste is recovered in the lower, funnel-shaped portion of tank 18, and discharged periodically through suitable orifices 24.

The lighter fuel products remain in the upper portion of the decantation tank and are transferred, by overflow over a partition 30, to a second so-called storage tank 26. In this storage tank 26, the level is maintained at a constant value. To this end, the operation of pump 12 is responsive to the value of this level by means of a switch gage 28. Thus, any decrease in the level of the fuel purified in tank 26, as detected by the switch gage 28, is attended by the operation of pump 12, so as to compensate this decrement. When necessary, this tank 26 can be drained, by means of orifices 24' provided at its bottom.

The storage tank 26, thus kept at a constant level, supplies fuel free of any impurities to the burner 32. The latter is supplied with purified fuel in the manner described hereinafter.

The storage tank 26 is connected to a burner 32 via a feed conduit 34, having a gate valve 36, a mechanical filter 40 and a magnetic filter 38 inserted therein. The gate valve 36 may be of the manual or electrically controlled type for shutting the conduit 34 when necessary, and the magnetic filter 38 is adapted to complete the filtration of the fuel supplied to the burner 32.

A return line 42, provided with a non-return valve 44, is provided for returning the unburnt fuel from the burner 32 to the storage tank 26.

The system also comprises an electric control cabinet 46 incorporating the apparatus necessary for controlling the various operations, together with corresponding pilot lamps. Fitted to the storage tank 26 is a gage 48, so that the operator can check at any time the level of purified fuel in this tank.

Figure 2:
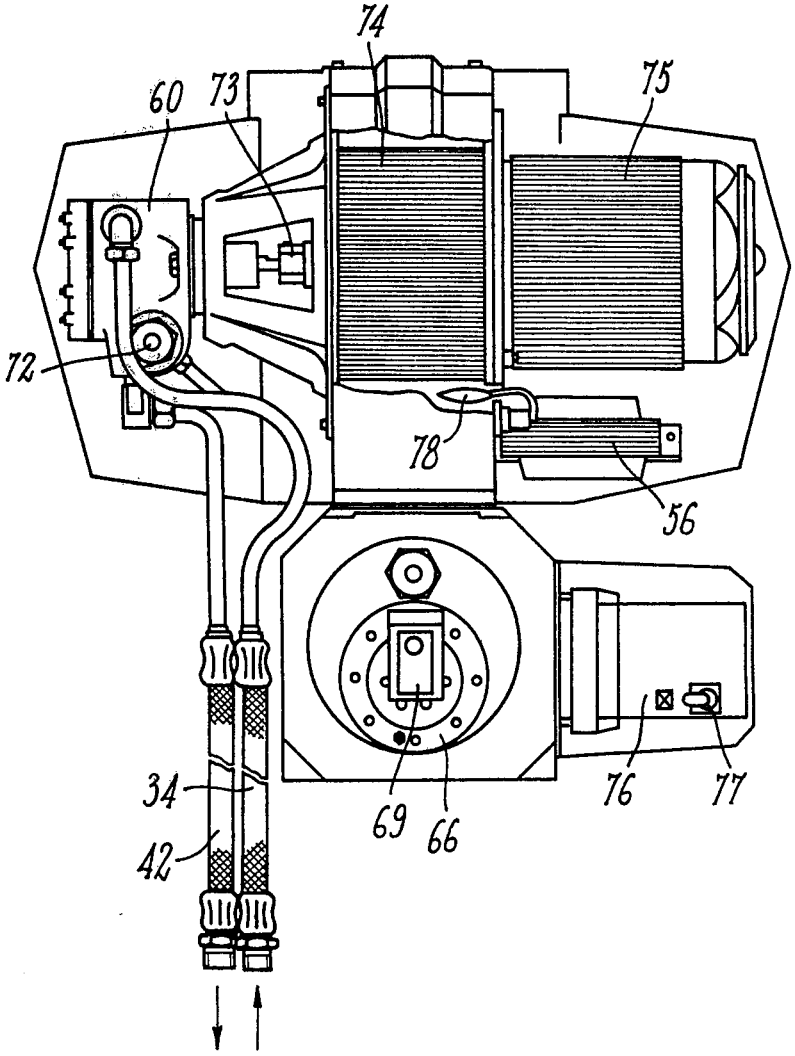
FIG. 2 is a diagrammatic side elevational view of the burner incorporated in the system of FIG. 1; and, FIG. 3 is a diagrammatic elevational view showing the burner of FIG. 2, as seen from the left-hand side thereof.
Figure 3:
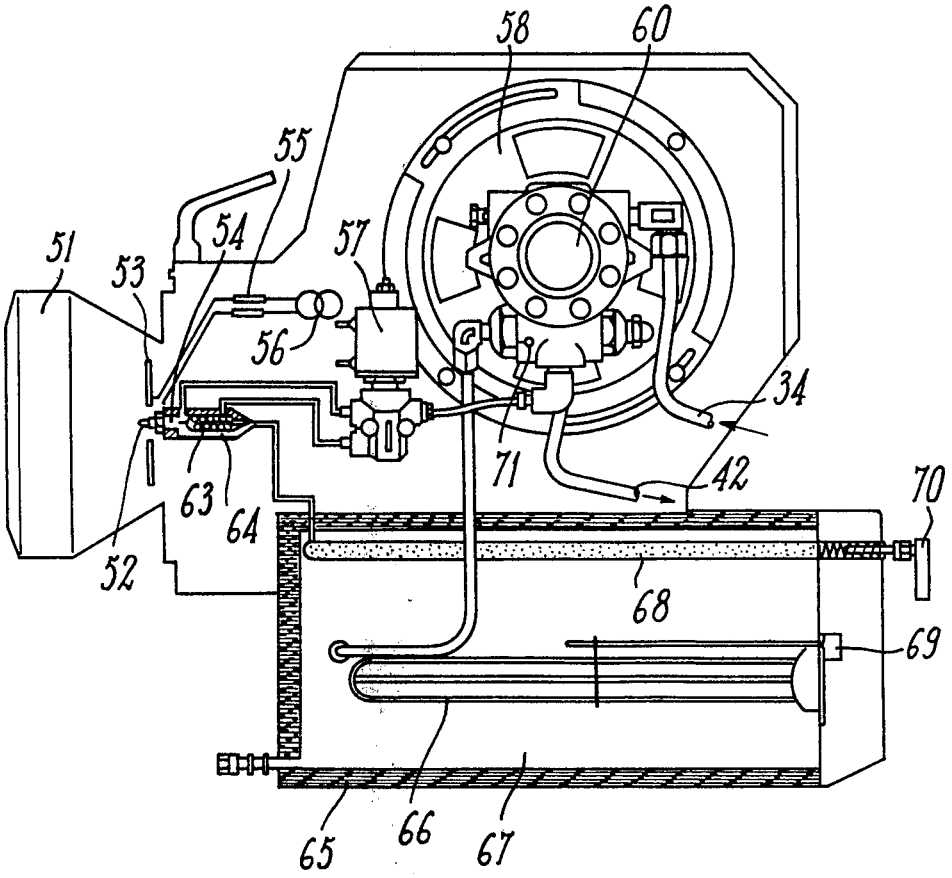

The burner operating with the above described supply circuit comprises (see FIGS. 2 and 3) an outflaring diffuser 51 having, disposed at its centre, a nozzle jet 52 surrounded by a flame starting baffle-disc 53.

The jet 52 terminates a jet-holder line 54 and includes a spring-loaded non-return valve 63, the spring of which is prestressed to provide a pressure of 19 bars. Ignition is produced by means of an electrode 55 energized by a high-voltage transformer 56, a photoresistant cell 58 being provided for controlling the flame.

The circuit for supplying fluid fuel from the fuel suction hose 34 and the fuel return hose 42 comprises a pump 60 and solenoid-operated valve 57, a pump 60 being driven through a coupling 73 from the motor 75, also driving a rotary fan or turbine 74. The pipe connection between the pump 60 and the jet 52 comprises a reheating reservoir 67, in which a fuel heating resistance 66 and heat-insulating means 65 are provided. This reservoir 67 also includes a micromesh filter 68 for supplying fuel to the jet 52, a thermostat 69 for regulating the fuel temperature, and a thermometer 70 for controlling the fuel temperature.

The burner fuel circuit is adapted to be drained by means of a screw 71, another screw 72 permitting the adjustment of the pump pressure.

The burner is started by actuating a switch 77, and an electronic box 76 controls the cycle of operation.

The burner supplied with fuel through the circuit shown in FIG. 1 operates as follows:

Firstly, the fuel is heated in the heating reservoir 67 by the resistance 66. The thermostat is set for switching off at a temperature of at least 100° C., and preferably 110° C., and the upward temperature gradient of the fuel is controlled by means of a thermometer 70. Under these conditions, and at this time, the fuel is inoperative.

A second stage of the operation is obtained or begins when the thermostat 69 reaches the preset temperature value. Then, this thermostat 69 controls the energization of the electric motor 75, via the electronic box 76. Thus, the motor 75 drives the rotary fan or turbine 74 during the pre-ventilation period, lasting about 20 seconds, and also the pump 60, so as to draw fuel through the hose 34 and force this fuel into the reheating reservoir 67, in which it is constantly kept at the proper temperature. The circulating fuel is then caused to pass firstly through micromesh filter 68, so as to remove the last particles of impurities therefrom, and then through the jet-holding line 54 which is closed, the fuel returning, through the return hose 42 and the still open solenoid valve 57, to the storage tank 26.

The pressure of the fuel circulating in the system is then of the order of 16 bars.

At the end of this 20-second ventilation period, the electrodes 55 are energized, and thus, a third stage of the operation of the device, during which the fuel is atomized, begins.

For this purpose, the electronic box 76 controls the closing of solenoid valve 57, and, therefore, the fuel circuit. This closing is attended by a pressure increment up to 21 bars, and controls the opening of the line holding the jet 54 through the action of the fuel pressure on valve 63, which compresses the spring 64, calibrated for a 16-bar pressure.

The air throughput is adjusted by gradually opening or closing the butterfly valve 58.

The proper operation of this system is obtained by decanting the fuel in the tank 18 while this fuel is heated by the resistance 20. The decanted fuel is transferred, via the overflow 30, to the constant-level storage tank 26. The thus prepared fuel is then fed to the burner 32, causing the fuel to flow under a relatively high pressure (in excess of 19 bars). Moreover, the pump 60 is set to deliver an output corresponding to at least twice the burner fuel consumption, this fuel being re-heated to reach a relatively high temperature (of the order of 110° C.), which, combined with the considerable fuel pressure, helps to operate the burner, while the excess fuel is returned at the same high temperature to the storage tank 26.

It will be readily understood by those conversant with the art that this invention should not be construed as being strictly limited to the exemplary embodiment shown and described herein, since it comprises all possible modifications and variations thereof. Thus, more particularly, one or several successive decantation tanks 18, as well as one or a plurality of storage tanks, may be provided in actual practice, as a function of the magnitude of the heat energy involved.

What I claim is:

1. A system for combustion of liquid fuels, particularly low grade mineral oil products, said system comprising:

first storage tank means for storing therein a supply of liquid fuel;

first transfer means for discharging said liquid fuel from said first storage tank means;

decantation tank means for receiving the thus discharged liquid fuel from said first transfer means and for decanting waste particles from said liquid fuel;

second storage tank means for receiving and storing therein the thus decanted liquid fuel from said decantation tank means;

overflow means, connecting said decantation tank means with said second storage tank means, for transferring said decanted liquid fuel from said decantation tank means to said second storage tank means;

burner means for burning said decanted liquid fuel; and second transfer means for supplying said decanted liquid fuel from said second storage tank means to said burner means.

2. A system as claimed in claim 1, further comprising heating means, positioned within said decantation tank means, for heating said discharged liquid fuel to a temperature suitable for the decantation thereof, and thermostat means for controlling the operation of said heating means as a function of the temperature of said liquid fuel in said decantation tank means.

3. A system as claimed in claim 1, wherein said first transfer means comprises a pump, and further comprising control means for detecting the level of said decanted liquid fuel in said second storage tank means and for controlling the operation of said pump as a function of the detected level.

4. A system as claimed in claim 1, wherein said overflow means comprises an upwardly extending partition separating said decantation tank means and said second storage tank means, said partition having an upper edge determining the level of overflow of said decanted liquid fuel from said decantation tank means to said second storage tank means.

5. A system as claimed in claim 1, wherein said burner means includes a nozzle jet, and said second transfer means comprises a reservoir, and pump means for transferring said decanted liquid fuel from said second storage tank means to said reservoir and then from said reservoir to said nozzle jet at a rate at least twice as great as the rate of fuel consumption by said burner means.

6. A system as claimed in claim 5, further comprising heating means positioned within said reservoir for heating said decanted liquid fuel therein to a temperature of at least 100° C.

7. A system as claimed in claim 1, further comprising waste discharge means at the bottom of said decantation tank means for discharging therefrom said waste particles.

* * * * *